United States Patent [19]

Russ

[11] Patent Number: 4,763,592

[45] Date of Patent: Aug. 16, 1988

[54] RADIO CONTROLLED BOAT LIFT

[76] Inventor: Larry Russ, 8686 D Kingsbridge, University City, Mo. 63132

[21] Appl. No.: 27,689

[22] Filed: Mar. 19, 1987

[51] Int. Cl.[4] ..... B63C 1/02

[52] U.S. Cl. ..... 114/45; 405/3

[58] Field of Search ..... 114/44, 45, 48, 49, 114/52, 53, 263; 405/1–4; 49/357; 340/825.72

[56] References Cited

U.S. PATENT DOCUMENTS

| | | | |
|---|---|---|---|
| 3,445,848 | 5/1969 | Goldstein | 340/825.72 |
| 3,754,187 | 8/1973 | Deming | 340/825.72 |
| 4,072,119 | 2/1978 | Williams | 114/45 |
| 4,306,413 | 12/1981 | Middleton | 114/48 |
| 4,510,877 | 4/1985 | Bloxham | 114/45 |
| 4,614,900 | 9/1986 | Young | 114/144 RE |

*Primary Examiner*—Joseph F. Peters, Jr.
*Assistant Examiner*—Stephen P. Avila
*Attorney, Agent, or Firm*—Rogers, Howell, Moore & Haferkamp

[57] ABSTRACT

A remote controlled boat lift comprises a remote transmitter unit that can selectively transmit one of two pre-determined RF signals, an up receiver and down receiver connected to operate a pressure pump system and valves for selectively inflating and deflating a pontoon supported framework for docking a boat.

11 Claims, 1 Drawing Sheet

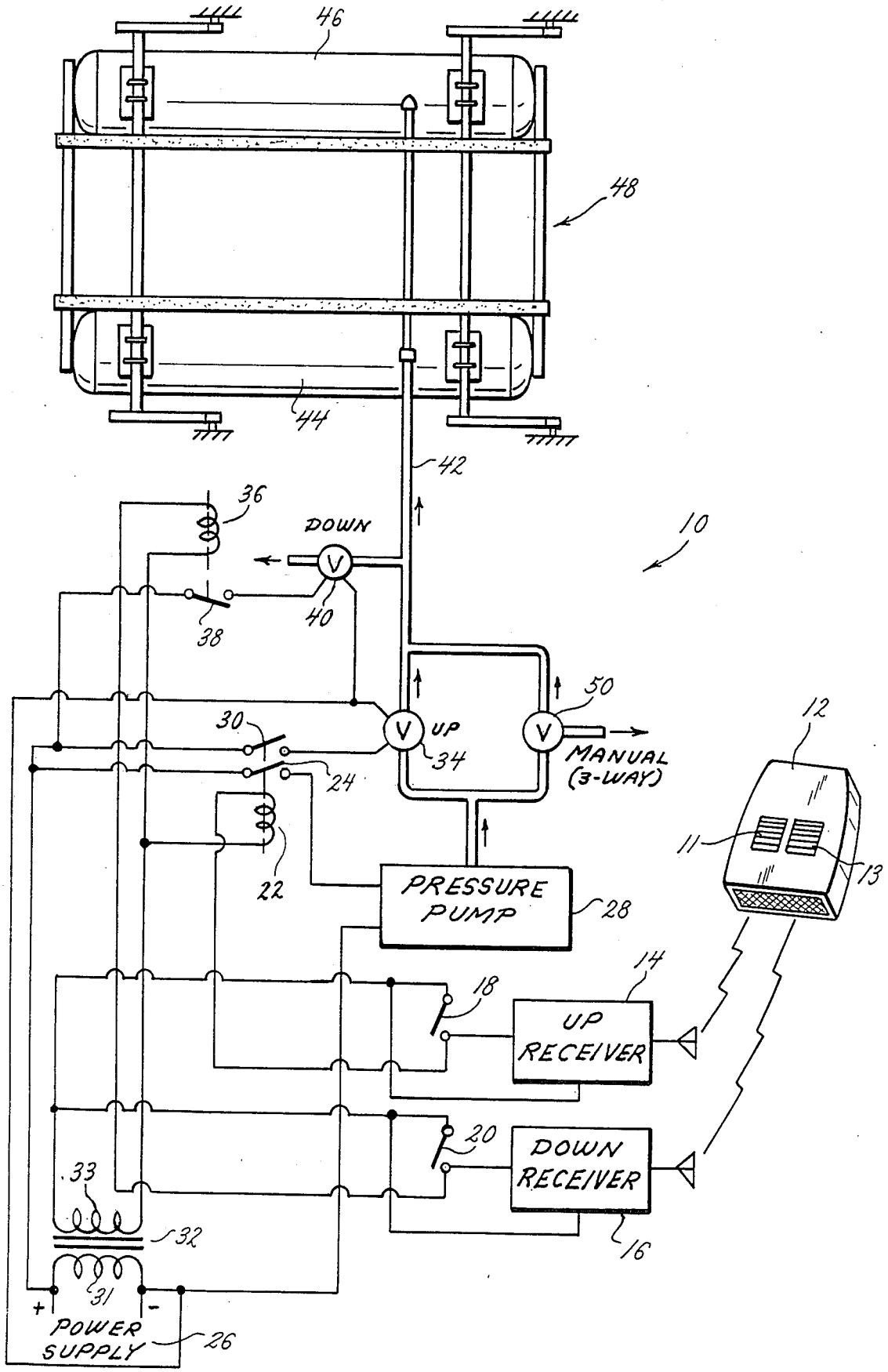
46
48
44
42
36
DOWN
V
40
38
10
50
30
V
UP
34
V
MANUAL
(3-WAY)
24
12
11
13
22
PRESSURE
PUMP
28
14
18
UP
RECEIVER
20
DOWN
RECEIVER
33
32
16
31
+
-
POWER
SUPPLY
26

RADIO CONTROLLED BOAT LIFT

BACKGROUND AND SUMMARY OF THE INVENTION

Many boat owners have pontoon type boat lifts in their docks which can be inflated to raise their boat out of the water when not in use to eliminate the problems associated with storing a boat floating in the water. A typical boat lift is shown in U.S. Pat. No. 4,072,119, entitled "VERTICAL RISING BOAT LIFT", issued Feb. 7, 1978. These prior art boat lifts are generally controlled by a manual control mounted on the dock which requires someone on the dock to operate the lift while the boat is docking or undocking. If the boat is undocking, it is necessary for the lift to first be deflated to permit the boat to be floated out of the lift, and then re-inflated to prevent damage to the lift. After re-inflation, the boat has to return to the side of the dock to pick up the person who remained there to manually operate the on-dock control. Of course, the process must be reversed to dock the boat. This procedure is an inconvenience and entails some danger as a passing boat could cause waves which might slam the boat against the dock or cause the person being picked up to misstep and go overboard. This procedure is also inconvenient and detracts from the enjoyment of boating. However, these lifts are generally expensive and if left in the deflated condition, they can be damaged or sunk and lost by the current, backwash or other similar water condition. Nevertheless, because of the inconvenience, many boat owners do not bother re-inflating the lift and instead take the risk of loss or damage.

To solve these and other problems of the prior art, the inventor herein has succeeded in developing a remote control device which enables a boat operator to raise and/or lower the boat lift while he is in the boat and not on the dock. With the present invention, an operator can lower the boat lift, board the boat, back the boat out of the dock, and then remotely raise the boat lift while he is in the boat. As can be appreciated, this permits one-man operation without leaving the controls of the boat, and also eliminates the problem of returning to the dock to pick up the lift operator or, conversely, leaving the lift submerged and susceptible to damage or loss.

The radio controlled boat lift of the present invention generally comprises a transmitter device capable of generating one of two pre-determined RF signals, a pair of receivers each of which is tuned to one of the transmitted RF signals, electrical control circuitry connected to the receivers and a pressure pump with valves to operate the boat lift. Additionally, manual pushbutton or lever controls can be provided as was typically utilized in the prior art to permit operation from the dock without possession of the remote control.

In operation, the boat lift initially is up with the boat out of the water and supported by the lift. An operator may then manually operate the lift to lower it, or alternatively utilize the remote control transmitter to lower the lift and boat down into the water. The operator and any passengers may then board the boat and the boat may be launched. After clearing the dock area and before leaving, the operator may then operate the remote transmitter to generate the first RF signal which when received by the correct receiver raises the lift out of the water to store it in a floating position. As mentioned above, this prevents damage or loss to the boat lift.

Upon returning, the operator then utilizes the remote transmitter to generate the other predetermined RF signal which is received by the down receiver and which deflates the lift to lower it into a submerged position. Once submerged, the boat may then be maneuvered into position in the dock and over the boat lift. The passengers and operator may then disembark, and either the remote transmitter or the local manual control may be utilized to inflate the boat lift and raise the boat out of the water for storage, as desired.

The remote control boat lift control of this invention provides the user with a safe, convenient, and enjoyable way to operate a boat lift while eliminating the disadvantages that are associated with manual operation.

BRIEF DESCRIPTION OF THE DRAWING

The drawing is a schematic diagram of the radio controlled boat lift control of the present invention.

DETAILED DESCRIPTION OF THE PREFERRED EMBODIMENT

The radio controlled boat lift of this invention is indicated generally as 10 in the drawing.

The radio controlled boat lift control has a transmitter unit 12 which transmits one of two radio frequency signals to either an up or inflate receiver unit 14 or a down or deflate receiver unit 16. The transmitter unit 12 is enclosed in a casing and may have two buttons, an up button 11 and a down button 13. The inventor has found that a dual frequency remote control garage door opener unit may be utilized as the transmitter and receiver portions of the present invention. Upon transmitting an up signal the up receiver unit 14 will energize relay 22 and close contact 24. With contact 24 closed, voltage is supplied from the power supply 26 which then turns pressure pump 28 on. The energizing of relay 22 also closes contact 30. With contact 30 closed, voltage is supplied from the power supply 26 to open the up or inflate valve 34. Therefore, the air from pump 28 flows through valve 34 to inflate pontoons 44, 46. A step down transformer 32 having a primary winding 31 and a secondary winding 33 is connected to the power supply 26.

A signal sent to the down receiver 16 will energize relay 36 and close contact 38. The closing of contact 38 will supply voltage from the power supply 26 to open the down or deflate valve 40, thereby deflating pontoons 44, 46.

A hose 42 connects the pressure pump 28 to each of the pontoons 44 and 46. To raise and lower the boat a frame assembly indicated generally as 48 is utilized. The frame assembly is not described in detail because its use is well known in the art of boat lifts.

With the radio controlled boat lift and the boat in the up position, the pontoons 44 and 46 are filled with air. When the user wishes to launch the boat, the down button 13 of the transmitter 12 is pressed and held down. Valve 40 opens, releasing air that has been stored in the pontoons causing buoyancy to be lost and the boat and frame 48 are lowered into the water. When the boat and frame have been lowered into the water, down button 13 is released and the driver and passengers may then safely board the boat. Releasing the down button 13 also causes valve 40 to close. The boat then clears the dock area and the user presses and holds down the up button 11 of the transmitter 12. Once the up button 11 is pressed and held down the pressure pump 28 is energized and valve 34 is opened. Air is forced into the pontoons 44, 46 through hose 42 and the frame 48 lifts upwardly until it is out of the water. When the frame 48 is out of the water the up button 11 is released shutting off valve 34 and pressure pump 28. If desired, timers may be substituted for relays 22, 36 and used to automatically raise or lower the lift after only an intermittent operation of buttons 11, 13.

Upon returning from the boating trip, the user presses and holds the down button 13 of the transmitter 12 to lower the boat lift into the water. Once the frame 48 is in the water the boat is then floated into position over the frame 48. Once the driver and passengers have safely disembarked the up button 11 of the transmitter 12 is pressed and held to lift the boat to its initial position.

Also, manual override switches may be provided for occasions when the user is on the dock and the transmitter 12 is not within reach. For example, manual switch 18 may be pressed to inflate the boat lift or manual switch 20 may be pressed to deflate the boat lift.

In addition to valves 34 and 40 there may be a manual valve 50 which allows the user to operate the boat lift manually.

There are various changes and modifications which may be made to this invention as would be apparent to those skilled in the art. However, these changes or modifications are included in the teaching of the disclosure, and it is intended that the invention be limited only by the scope of the claims appended hereto.

What is claimed is:

1. In a boat lift for selectively raising and lowering a boat out of and into the water, the boat lift comprising at least one inflatable pontoon, a framework attached to and supported by said pontoon, valve means to control flow of air into and out of said pontoon for inflating and deflating same, and means to generate a supply of pressurized air for inflating said pontoon, the improvement comprising means to remotely actuate said valve means and pressurized air generation means to selectively inflate or deflate the pontoon from on board the boat, and thereby selectively, remotely, raise or lower the boat lift.

2. The device of claim 1 wherein said remote actuator means comprises means to transmit an encoded RF signal, and means connected to the valve means and pressurized air generation means to receive and decode said transmitted RF signal, said encoded RF signal being indicative of either a raise or lower command.

3. The device of claim 2 wherein said transmitter means comprises means to transmit an RF signal having one of two pre-determined frequencies, the receiver and decoder means comprising a pair of receivers, each receiver being tuned to one of said pre-determined frequencies.

4. A remote control for a pneumatically operated boat lift, said remote control being adapted for operation from on board a boat, said pneumatically operated boat lift comprising at least one inflatable pontoon, valve means to control flow of pressurized air into and out of said pontoon, and a pressure pump, the remote control comprising a transmitter having means to transmit one of two pre-determined signals, a receiver means, said receiver means being responsive to said transmitted signals, electrical control means connected to the valve means and pressure pump and responsive to said receiver means to either inflate the pontoon or deflate the pontoon in response to the signal received from the transmitter.

5. The device of claim 4 wherein said one of two pre-determined signals comprises an RF signal having one of two pre-determined frequencies.

6. The device of claim 4 wherein the means for connecting the pressure pump to the valves comprises a hose.

7. The device of claim 4 wherein the receiver means comprises a first receiver responsive to only one of the pre-determined signals and a second receiver responsive to only the other of the pre-determined signals, the valve means comprises a first valve for controlling the input of pressurized air to the pontoon and a second valve for controlling the release of pressurized air out of the pontoon, and the electrical control means comprises a first relay connected between the first receiver and the first valve and pressure pump, and a second relay connected between the second receiver and the second valve.

8. The device of claim 7 further comprising:

a first manual pushbutton connected in parallel with the electrical control means, the first manual pushbutton having means to operate the boat lift control locally; and a second manual pushbutton connected in parallel with the electrical control means, the second manual pushbutton having means to operate the boat lift control locally.

9. A remote controlled boat lift control for selectively raising or lowering a boat lift out of or into the water, said control being adapted for operation from on board a boat, the boat lift comprising a framework for supporting the boat, a pontoon secured to the framework, and a pressurized air supply, the boat lift control comprising: a transmitter having means to transmit one of two pre-determined signals; a pair of receivers, each receiver being tuned to only one of the pre-determined signals; a pair of electrically operable pneumatic valves, one of said valves being connected between the pressurized air supply and the pontoon to control the inflation thereof, the other of said valves being connected between the pontoon and the atmosphere to control the deflation thereof; and a pair of relays, each of said relays being connected between one of the receivers and one of the valves so that as either one of the receivers responds to its tuned signal, its associated relay operates its associated valve to either inflate or deflate the pontoon to thereby raise or lower the boat lift.

10. The device of claim 6 wherein the transmitter comprises means to transmit an encoded RF signal.

11. The device of claim 9 wherein the pressurized air supply comprises an air pressure pump, and wherein the relay associated with the pressurized air supply further comprises means to operate the air pressure pump.

* * * * *